United States Patent [19]

Shoemaker, Jr.

[11] Patent Number: 4,726,585

[45] Date of Patent: Feb. 23, 1988

[54] AMUSEMENT APPARATUS

[76] Inventor: Stephen P. Shoemaker, Jr., 123 International Boardwalk, Redondo Beach, Calif. 90277

[21] Appl. No.: 33,514

[22] Filed: Apr. 1, 1987

[51] Int. Cl.[4] ..... A63F 9/00

[52] U.S. Cl. ..... 273/1 GC; 221/209; 273/1 GE

[58] Field of Search ..... 273/1 G, 1 GC, 1 GE, 273/1 GG, 1 GH, 138 A, 379; 221/208-210, 224, 226, 232, 245, 253, 258, 268, 270, 281

[56] References Cited

U.S. PATENT DOCUMENTS

| | | | |
|---|---|---|---|
| 1,878,894 | 9/1932 | Sallee | 221/210 |
| 1,927,877 | 9/1933 | Meyer | 221/210 |
| 1,938,834 | 12/1933 | Graf | 221/210 |
| 2,005,692 | 6/1935 | Margolith | 221/209 |
| 2,057,880 | 10/1936 | Collison et al. | 221/209 X |
| 2,302,821 | 11/1942 | Walton | 221/209 X |
| 3,572,703 | 3/1971 | Greene | 221/210 |
| 4,133,525 | 1/1979 | Balles et al. | 221/209 X |

*Primary Examiner*—Paul E. Shapiro

*Attorney, Agent, or Firm*—Brown, Martin, Haller & Meador

[57] ABSTRACT

An amusement apparatus or game comprises a moveable surface on which a plurality of items are distributed, and a pusher device for operation by a player in attempting to push items off the surface. The moveable surface is driven in a first predetermined path, and the pusher device is moveable in a linear path transverse to the path of travel of the surface. A reversible drive mechanism which is at least partially controlled by the player moves the pusher device in a linear path transversely across the moving surface. A delivery chute at one end of the path of the pusher device is arranged to deliver any item swept off the surface to the player.

16 Claims, 8 Drawing Figures

AMUSEMENT APPARATUS

BACKGROUND OF THE INVENTION

The present invention relates to an amusement apparatus or game of the merchandising type in which a person attempts to remove items from a moving surface.

Merchandising devices of this general type are known in which items are distributed over a rotating table within a housing. A player attempts to push items from the surface with the aid of an arm which is pivoted at one end and travels in an arc over part of the rotating surface. The free end of the arm has a pusher device for attempting to push items off the travelling surface.

There are a number of disadvantages with this type of amusement apparatus. One problem is that the supply of prize items is quickly depleted, and the machine must then be taken out of service for restocking. Another problem is that it will be very difficult for the player to judge accurately when to start the arm moving so that the free end of the arm will eventually coincide with a desired item and be able to push it off the table. It is very difficult to judge the point of interception of an arm moving in an arced path at a first speed with a circular path moving at a second speed. Thus, this type of machine can be very confusing for the customer.

SUMMARY OF THE INVENTION

It is an object of the present invention to provide an improved amusement apparatus of the type in which an operator attempts to retrieve prizes from a moving surface.

According to the present invention an amusement apparatus is provided which comprises a continuously moveable surface on which a plurality of prize items can be deposited, at least one pusher device for moving across the moveable surface in a direction transverse to the path of travel of the surface, and a reversible drive mechanism for moving the pusher device back and forth in a linear path between a start position and a stop position. A delivery chute is provided adjacent one end of the path of travel of the pusher device to deliver any item pushed off the surface to the operator. A control system is provided for controlling movement of the pusher device, and includes a player control assembly for allowing at least partial control by the player of the movement of the pusher device towards the delivery chute. An automatic feed mechanism is provided for periodically delivering items to the moveable surface to replace items removed by players.

The moveable surface may comprise a conveyor belt moveable in a linear path past one or more player control stations each associated with a respective pusher device. In the preferred embodiment of the invention the conveyor belt is in two sections which are arranged side by side and are driven in opposite directions. Prize items reaching the end of one section are directed onto the other section by a suitable guide member.

The feed mechanism for replenishing the supply of items on the moving surface preferably comprises a suitable storage bin beneath the conveyor containing a supply of prize items, and an elevator mechanism for raising items from the bin one by one to the level of the conveyor and depositing them on the conveyor surface. The elevator mechanism may be actuated in response to delivery of a prize item to a player, so that each time an item is pushed from the playing surface by the player, a further item is delivered to the surface. This ensures that there is always the same number of items on the playing surface, and that the apparatus does not need to be restocked frequently. The operator merely has to replenish the supply in the storage area as necessary. Prize items will remain on the surface until and unless they are removed by a player.

The moveable surface may alternatively be a single continuous conveyor belt, with one or more player control stations spaced along it. In this case unretrieved items which reach the end of the belt are directed into the storage bin or area and will subsequently be returned to the playing surface via the elevator mechanism. In another alternative embodiment the moveable surface comprises a rotating table having a central opening through which items are delivered to the playing surface. One or more pusher devices are arranged to move in a radial path across the table between the central opening and the outer edge of the the table in alignment with the path of each pusher device. In this case a suitable detector may be provided for detecting when the supply of items on the table needs to be replenished, and this may be associated with the elevator mechanism extending from an item supply below the table upwardly through the central opening of the table for delivering items to the table.

Preferably, the pusher device is secured to a pulley-type drive mechanism extending between opposite ends of the linear path, the pulley being driven by a reversible motor connected to the control system for controlling movement of the pusher device.

Since the pusher device moves in a linear path across the moving surface, it will be possible for the operator to make a relatively good estimate, particularly with playing experience, of the point at which the pusher device should be started in order to coincide with the path of travel of a desired item on the moving surface. Good timing, judgment and hand-eye coordination will be important factors in retrieving items from the playing surface. Prize items are automatically fed onto the moving surface while the apparatus is in operation, so that the machine does not need to be taken out of service for restocking as frequently as usual in a merchandizing type apparatus.

BRIEF DESCRIPTION OF THE DRAWINGS

The present invention will be better understood from the following detailed description of a preferred embodiment of the invention, taken in conjunction with the accompanying drawings in which like reference numerals refer to like parts and in which.

DESCRIPTION OF THE PREFERRED EMBODIMENT

Figure 1:
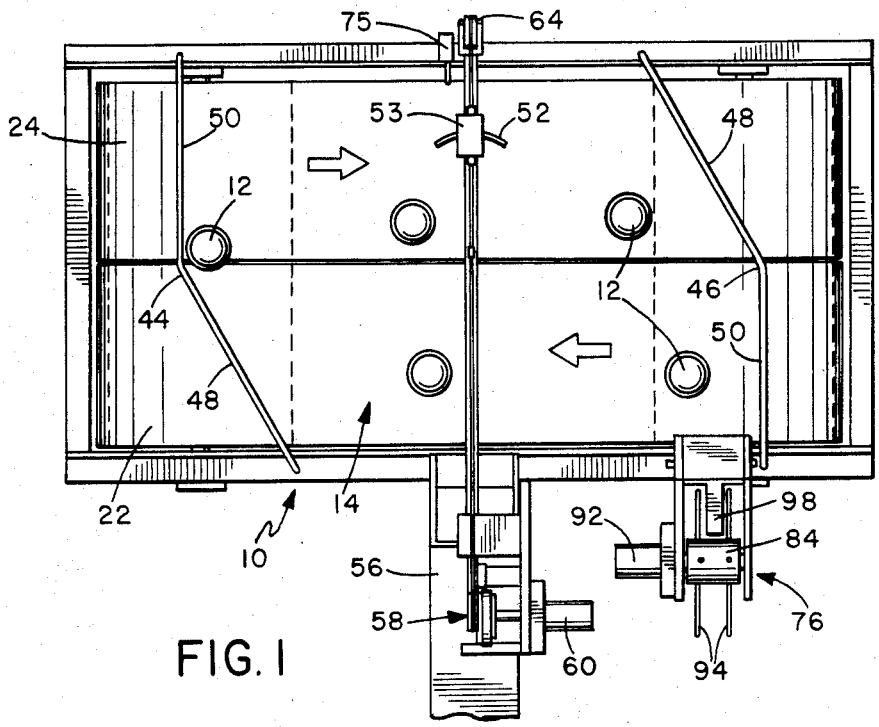
FIG. 1 is a top plan view of the apparatus according to a preferred embodiment of the invention.

The drawings show a preferred embodiment of an amusement apparatus 10 according to the present invention in which one or more players or operators can attempt to move prize items 12 from a moving surface 14. The apparatus 10 is suitably enclosed in a housing 15 (see FIGS. 3 and 4) having an upper window or windows 16 to enable a player at player control station 20 to view the surface 14. The player control station is preferably at about waist height for comfortable operation of the apparatus.

Figure 2:
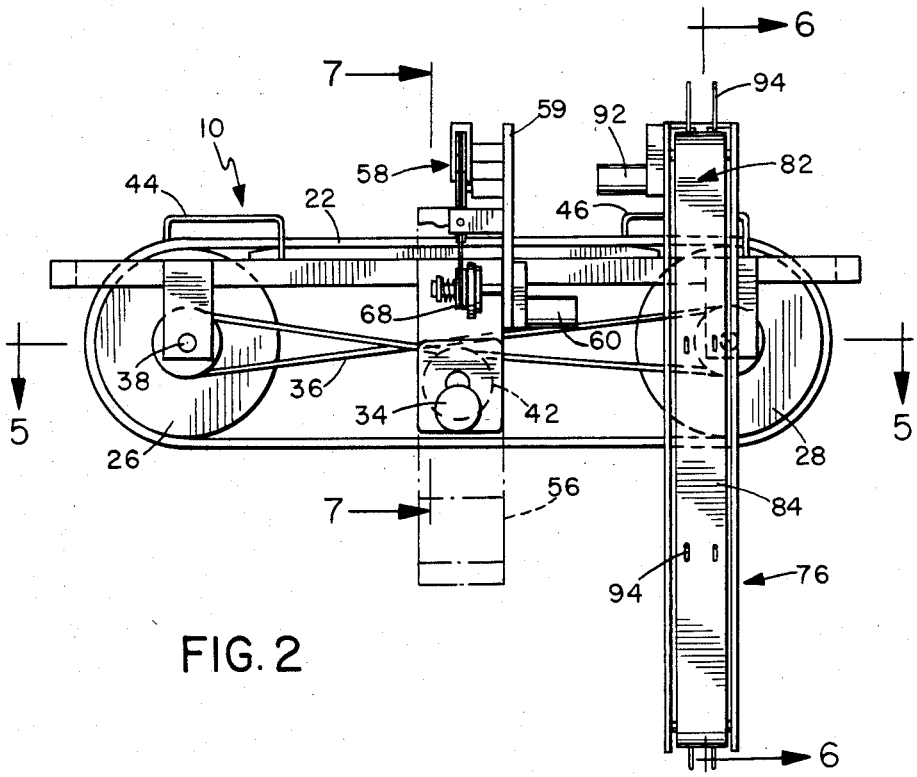
FIG. 2 is a front elevation view of the apparatus.
Figure 5:
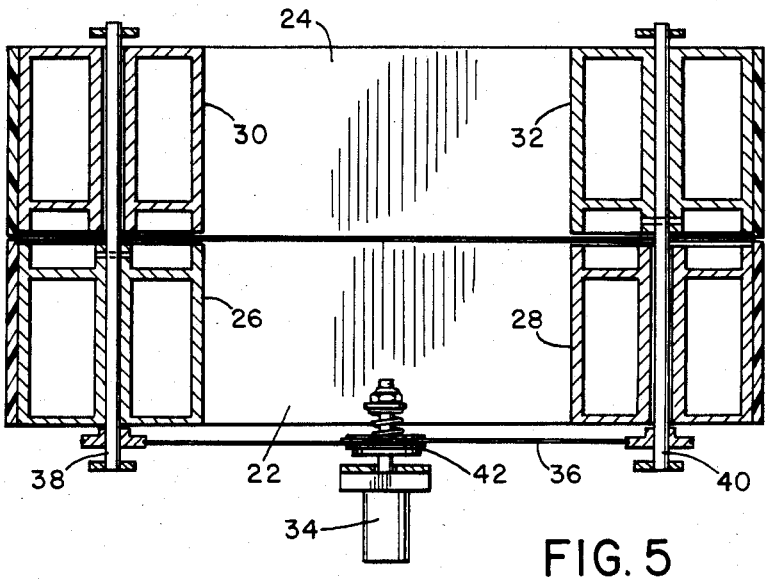
FIG. 5 is a sectional view taken on the line 5—5 of FIG. 2.

The moving surface 14 comprises two conveyor belt sections 22, 24 which are suitably of a continuous belt type, and which extend side by side as shown in FIG. 1 and are driven in opposite directions, as indicated by the arrows in FIG. 1. Each continuous belt section extends around rollers or wheels 26, 28 and 30, 32 respectively, at opposite ends of the belt sections, as best shown in FIG. 5. The belts are driven in opposite directions by means of drive motor 34, which is linked by a continuous drive belt 36 to two axles 38, 40 at opposite ends of the conveyor belt sections, as shown in FIGS. 2 and 5. The belt crosses over as shown in FIG. 2 so that the axles 38 and 40 will be driven in opposite directions. Thus the belt extends around the gear wheel 42 of motor 34, in a first direction around the axle 38, crosses over, and extends in the opposite direction around axle 40. The axle 38 is linked to the drive wheel 26 of belt section 22, while roller 30 of the other belt section is mounted to roll freely on axle 38. At the opposite end of the belt sections, roller 28 is a free or idle roller while roller 32, which is the drive roller, is linked to the axle 40. Thus the two belt sections are driven in opposite directions via drive wheels 26 and 32, respectively. The drive motor and rollers are suitably enclosed in the lower part of the housing, where they will not be visible to a player. The size of the window or windows is preferably such that the player can only see the upper surface of the conveyor belt sections as they travel between opposite ends of the conveyor path.

Suitable dividers or guides 44, 46 are provided at opposite ends of the conveyor sections for directing prize items from one section to the next, as indicated in FIG. 1. These may comprise partitions or wires, and suitably each comprise an inclined section 48 at the end of the belt section travelling towards the guide, and a straight section 50 extending across the other belt section moving away from the guide. The inclined section is suitably inclined at an angle of about 30 degrees to the conveyor surface. Thus, referring to the left hand end of the belt sections in FIG. 1, prize items approaching guide 44 will be directed along inclined section 48 across the belt section 22 and along part of section 50 onto belt section 24, where they will be picked up and travel away on the section 24 towards the opposite end guide 46. Thus prize items will circulate continuously on the two belt sections unless retrieved by a player, as explained in more detail below.

Figure 3:
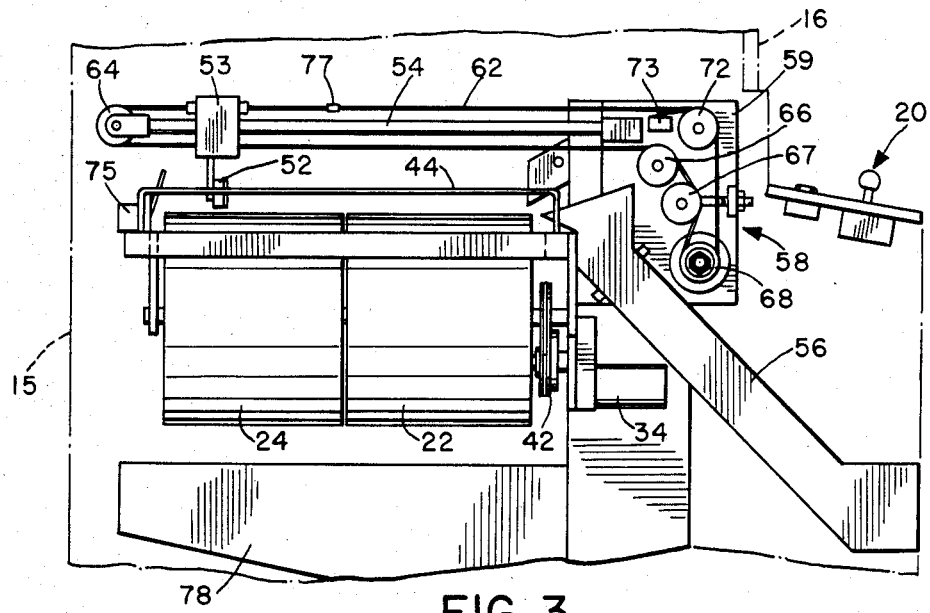
FIG. 3 is a side elevation view as taken from the left of FIG. 2.
Figure 4:
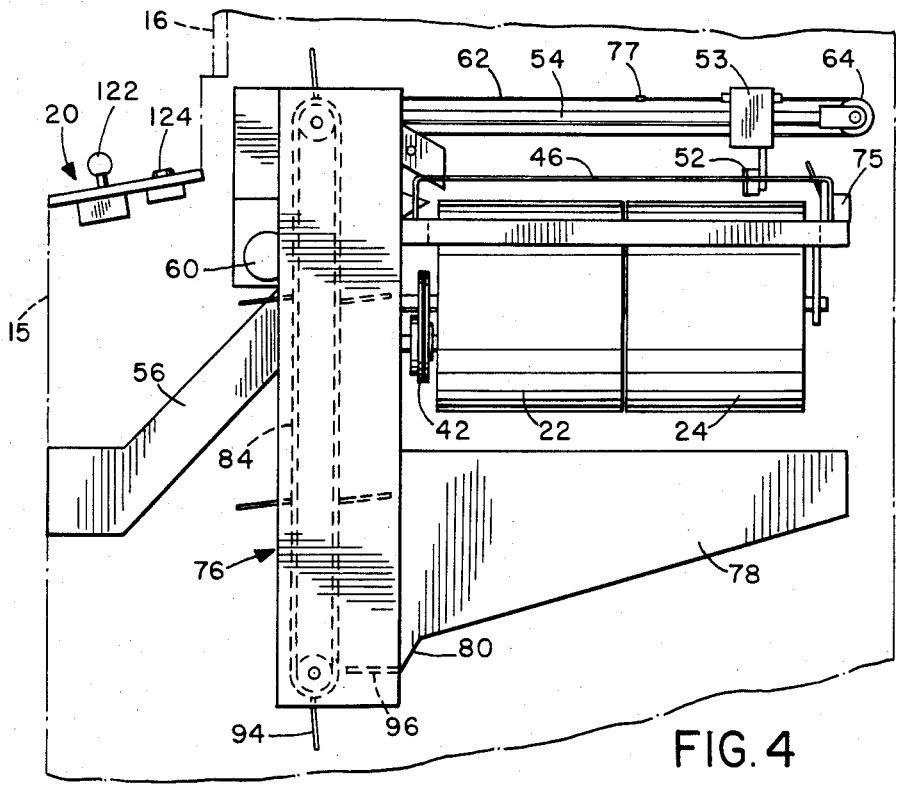
FIG. 4 is a side elevation view as taken from the right side of FIG. 2.
Figure 7:
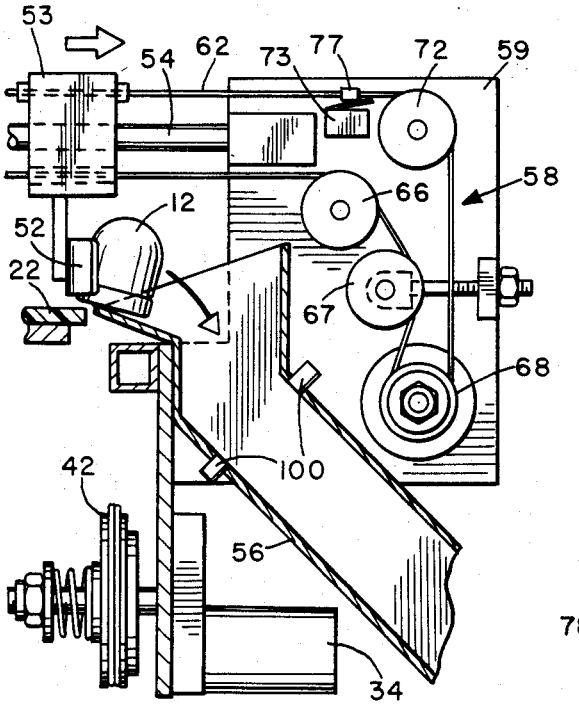
FIG. 7 is an enlarged sectional view taken on the line 7—7 of FIG. 2.

One or more player control stations 20 are located at spaced intervals along the belt, at which players can attempt to push items off the belt using a pusher or scoop device 52. The length of the belt sections will be dependent on the number of player control stations required, and two or more of the units shown in FIG. 1 may be placed end to end or back to back in a single housing for an increased number of players. The unit as shown in FIG. 1 may have one or more player control stations, according to its length, and player control stations may be provided along one or both outer side edges of the belt sections. Each player control station 20 is associated with a pusher device or scoop 52 which is suspended from carriage 53 which is slidable back and forth on slide rod 54 in a linear path between opposite side edges of the conveyor belt sections, as best seen in FIGS. 1, 3 and 4. A delivery chute 56 is located adjacent one end of the pusher device path for delivering any items pushed off the belt by the device to the player. The chute opening is located in the housing at the player control station, as seen in FIG. 3. The pusher device is driven back and forth along rod 54 between a start position and a stop position above the delivery chute by means of a reversible pulley drive mechanism 58 mounted in a unit 59. The mechanism is driven by pusher drive motor 60. As best seen in FIGS. 3 and 7, pulley line 62 is connected at one end to one side of the pusher device carriage 53, extends around pulley roller 64 at one end of rod 54, around roller 66 at the opposite end of rod 54, around tensioning device 67 and motor driven roller 68, and then back around roller 72 to be connected to the opposite side of pusher device carriage 53. Thus motor operation in forward (clockwise rotation of roller 68 in FIG. 7) will pull the pusher device along the rod in a linear path towards the delivery chute, while reverse operation of the motor will pull it back towards the opposite end of the rod. Limit switches 73, 75 are provided at the opposite ends of travel of the pusher device in order to stop or reverse the drive motor, as explained below. Limit switch 73 adjacent the delivery switch is operated by switch contact 77 which is mounted in advance of the pusher device on the pulley line. As indicated in FIG. 7, the contact is positioned so that the switch 73 is actuated when any prize picked up by the scoop or pusher reaches the top of the delivery chute.

As shown in FIG. 3, the slide rod is attached to the housing only at the end adjacent the delivery chute, with the other end of the rod floating. This allows for easy service, since the rod is preferably secured at its mounted end with wing nuts for easy removal and repair. The motor, pulleys and pusher device are all mounted on the unit 59, as indicated in FIG. 7, which is preferably removable.

Figure 6:
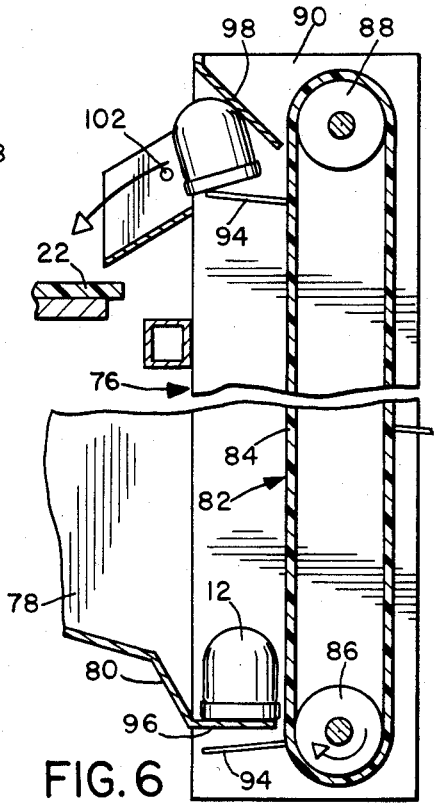
FIG. 6 is an enlarged sectional view taken on the line 6—6 of FIG. 2.

FIGS. 4 and 6 of the drawings illustrate a feed or delivery mechanism 76 for supplying prize items to the conveyor belt surface from a holding or storage area or bin 78 beneath the conveyor belt sections. The bin 78 is suitably of the hopper type with an inclined lower wall leading into a chute 80 for directing prize items towards a platform 96 at the lower end of an elevator device 82 for lifting items onto the playing surface of the conveyor belts, as shown in FIG. 6.

The elevator device 82 comprises a continuous vertical belt 84 extending around roller 86, 88 at the upper and lower end of elevator housing or mounting plates 90. One of the rollers 88 is driven by motor 92 (see FIG. 1) in the direction of the arrow in FIG. 6. Spaced pairs of claws or fingers 94 are provided at spaced intervals along the belt, and any prize item resting in the inlet area or platform 96 at the lower end of the elevator will be picked up by the claws and raised to the top of the shaft. At the top of the shaft the picked up prize is directed off the claws and onto the playing surface via guide arm 98 which projects across the path of the claws. In order to ensure that only one prize at a time can be picked up, the delivery hopper may be designed so that only one item at a time can be fed onto the platform. Alternatively, an additional claw or finger may be provided in advance of each pair of pick up claws, with the spacing between the claws being equivalent to the size of a single prize item.

There may be any number of prize items on the surface at any one time according to the operator's choice. However, generally for optimum operation there should preferably be between about one and fifteen prizes on the surface for a one player apparatus, with a greater number of prizes if the game dimensions are larger.

Preferably, the elevator mechanism which raises prize items from the holding area onto the playing surface is only operated after a prize has been pushed off the surface by a player. This ensures that there will always be an equal number of prizes on the playing surface. The prize delivery chute has a suitable detector 100, (see FIG. 7) which may be a photoelectric detector as shown or leaf switch, arranged to detect delivery of a prize to a player. The elevator mechanism is operated in response to a signal from detector 100, and a similar detector 102 (FIG. 6) detects replacement of a new prize onto the playing surface to stop the elevator mechanism.

Alternatively, the feed mechanism for loading prizes onto the belt may be arranged to drop prizes from an overhead dispensing apparatus.

Figure 8:
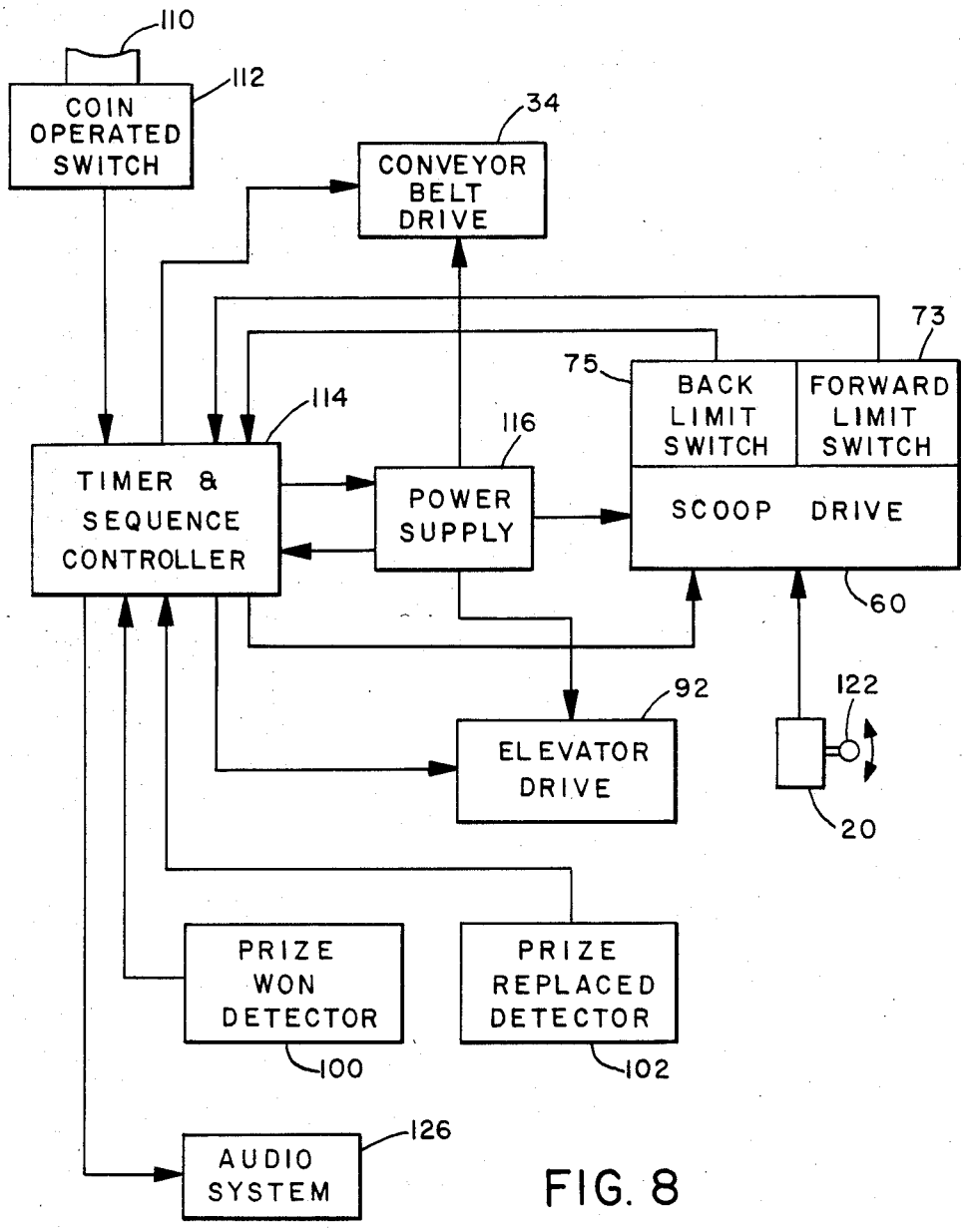
FIG. 8 is a block diagram of the control system.

Operation of the apparatus will now be described in more detail with reference to FIG. 8, which is a block diagram of the control system which controls operation of all the drive motors. A game sequence is initiated by insertion of the appropriate coin or token into a slot 110, which actuates switch 112 to operate the timer and sequence controller 114 to initiate a game. At this point the power supply 116 is switched on and the conveyor belt drive motor 34 is actuated to drive the conveyor belt sections. At the same time the pusher or scoop drive motor 60 is actuated and player control of the scoop is initiated.

The player can control movement of the scoop via a joystick 122, pushbutton control 124, or any other suitable control device. The two way joystick 122 allows the player to push the scoop back and forth along its linear path along a slide rod. The controller may allow player control of the scoop movement along the entire length of the rod, but the player is preferably only allowed to control the movement along about one half to one third of the length of the rod, with the movement being automatic after the scoop reaches a predetermined point in its travel towards the delivery chute. This point may be detected by a suitable additional limit switch similar to switch 73 at the appropriate point along the slide rod, for example. Alternatively, the player may be allowed to control pusher movement in the forward direction (towards the delivery chute) only. If player control is via a switch button control only, pushing of the button may start an automatic cycle of movement of the pusher device along the rod to the delivery chute and back to the home position. Alternatively, pushing of the button may be arranged to nudge the scoop along its path each time the button is pushed. The playing sequence will be of a limited time duration as controlled by the timer and sequence controller, and once the alloted time is reached, the pusher will be automatically returned to a home position (which may be at the opposite end of travel to the delivery chute) and power to the various drive motors will be cut off.

Thus, once a game sequence is initiated the player watches the prize items as they pass by on the moving belt sections, and moves the scoop linearly into a position which the player judges to coincide with the path of movement of a prize across the scoop path. Timing and hand-eye coordination is critical in accurately judging the movement of the scoop to coincide with a prize. Once a prize has been located in the scoop, the player moves it across the belt section or sections via the joystick either to a limit switch position after which movement to the delivery chute is automatic, or to the end limit position of travel of the scoop. At this point the prize will be delivered, and the motor will be reversed automatically to drive the scoop back to an appropriate home or start position. At the same time, the elevator drive motor 92 will be actuated to deliver a new prize to the playing surface, and will be switched off once prize replacement is detected.

Alternatively, if the player is unsuccessful, the game sequence will be ended after a predetermined time interval by automatically driving the scoop back to the selected home position and switching off power to all drive motors.

Preferably, the sequence controller is linked to an audio system 126 for providing suitable sound effects during the game sequence.

The prizes may be loose or may be provided in boxes or transparent capsules as shown in the drawings. The size of prizes will depend on the overall dimensions of the apparatus, but may be of the order of 2 square inches or more. The difficulty of the game may be adjusted in various ways. For example, the speed of the belt sections may be varied, with a slower speed making it easier for the player to judge the point at which a prize will cross the path of travel of the scoop. The speed of the scoop or pusher can be varied in the same manner. The relative speeds of the pusher and belt sections will determine the difficulty in successfully capturing and pushing a prize. The slower the pusher moves in relation to the belts, the more difficult the task of pushing a prize becomes. Also, the size of the blade or scoop can be varied to determine the skill level. Clearly the larger or wider the blade, the easier it will be to push a prize. The player will be able to see the skill level involved by observing these factors. Additionally, if the player control is via a one time button rather than a continuous joystick action, so that the player pushes the button and the pusher is then driven automatically across the playing surface, it will be much more difficult to retrieve prizes.

Thus the operator can select the appropriate skill level, and the player will be able with practice to judge the point of interception of the scoop path with the path of travel of a prize item, and to time the movement of the scoop appropriately to coincide with the prize crossing its path. Since the scoop and prize move in linear transverse paths, it will be possible to judge the point at which a prize will cross the path of the scoop relatively easily, and thus with appropriate timing and hand-eye coordination the skilled player will be able to retrieve prizes relatively successfully.

If there is more than one player control station spaced along a single belt section, suitable guides are provided in the belt path immediately following each player station for guiding prizes pushed towards the edge of the belt by a player back towards the center of the belt.

Instead of two side by side belt sections, a single continuous conveyor belt may be used as the playing surface. However, in this case unretrieved prizes will fall off the end of the belt and must be recycled from the storage area back onto the surface repeatedly. Thus the two belt section version shown in the drawings is preferred. In another alternative version the playing surface may comprise a rotating table with spaced pusher devices moving in radial paths from the center of the table out to its outer periphery where suitable prize delivery chutes are located. In this case the prize feed mechanism and pusher drive mechanism will be the same as described above in connection with the drawings, with the table having a central opening through which the elevator projects to deliver prize items onto the playing surface each time delivery of a prize to a player is detected.

The amusement apparatus of this invention provides a high degree of success to the experienced player and thus improves player satisfaction. The apparatus can stock a large number of prizes while only relatively few prizes need be on the playing surface at any one time. In the preferred embodiment of the invention a storage compartment capable of holding up to 300 prizes is provided. The playing surface is automatically refilled as long as prizes remain in the storage area, so that frequent operator restocking is not necessary as is generally the case with other amusement devices of the merchandizing type. There will be relatively little wear and tear on the prizes on the playing surface.

The outer surfaces of the conveyor belt sections are preferably covered with mirrored squares, which adds to the attractiveness of the play area. Conveyor belts are very reliable, and all the drive motors have clutch transmissions to avoid motor burn out in the event of a jam in the mechanism. Although separate motors for driving the conveyor sections, scoop and elevator are shown, in practice the same motor may be used to drive the conveyor and elevator belts. Both the pusher drive unit and the elevator feed unit are preferably removable for easy servicing.

Although a preferred embodiment of the invention has been described above by way of example only, it will be understood by those skilled in the field that modifications may be made to the disclosed embodiment without departing from the scope of the invention, which is defined by the appended claims.

I claim:

1. An amusement apparatus, comprising:

a moveable surface for transporting prize items distributed on the surface in a first path which is linear along at least part of its length;

at least one pusher device for moving across the moveable surface in a linear path between opposite end positions transverse to a linear portion of the first path and for pushing items in its path off the moveable surface;

a reversible drive mechanism for moving the pusher device back and forth along its linear path;

delivery means adjacent one end position for delivering items pushed from the moveable surface by the pusher device to an operator; and control means for controlling operation of the reversible drive mechanism, including a player control assembly for allowing at least partial control by the player of the movement of the pusher device towards the delivery means.

2. The apparatus as claimed in claim 1, including automatic feed means for periodically delivering items to the moveable surface to replace items removed by players.

3. The apparatus as claimed in claim 2, including storage means beneath the moveable surface for storing items, and means for feeding items one by one onto the automatic feed means, the automatic feed means comprising an elevator mechanism for raising items from the storage means to the level of the moveable surface, and means for delivering items from the elevator mechanism to the surface.

4. The apparatus as claimed in claim 3, wherein the elevator mechanism comprises a continuous vertical elevator belt, spaced pick up means along the belt for picking up items from the storage means, and drive means for driving the elevator belt to raise items engaged by the pick up means to the playing surface.

5. The apparatus as claimed in claim 4, wherein the pick up means comprise claws.

6. The apparatus as claimed in claim 2, including detector means for detecting delivery of an item to the delivery means, and means for actuating the automatic feed means in response to a signal from the detector means to feed an item onto the playing surface to replace the item removed.

7. The apparatus as claimed in claim 1, including a horizontal rod extending across the moveable surface and spaced above it along the path of travel of the pusher device, the pusher device being slidably mounted on the rod, and the reversible drive mechanism comprising a pulley drive secured to the pusher device for moving it back and forth along the rod.

8. The apparatus as claimed in claim 1, wherein the control means includes means for detecting when the pusher device reaches a predetermined point in its path of travel towards the delivery means, means for allowing player control of the movement of the pusher device up to the predetermined point, and means for automatically moving the pusher device from the predetermined point to the end position adjacent the delivery means and then returning the pusher device to the opposite end position.

9. The apparatus as claimed in claim 1, wherein the player controlled means comprises means for allowing the player to move the pusher device during a predetermined time period back and forth along at least part of its path.

10. The apparatus as claimed in claim 1, wherein the moveable surface comprises at least one conveyor belt moving in a linear path.

11. The apparatus as claimed in claim 10, including a plurality of player control stations spaced along the conveyor path, each station including a pusher device moveable back and forth across the conveyor path, a delivery means adjacent one end of the path, and a control system for controlling movement of the pusher device, the control system including player control means for at least partially controlling movement of the pusher device towards the delivery means.

12. The apparatus as claimed in claim 1, wherein the moveable surface comprises two conveyor belt sections arranged side by side and drive means for driving the belt sections in opposite directions.

13. The apparatus as claimed in claim 12, including guide means at opposite ends of the conveyor belt sections for guiding items from one belt section to the other so that they move continuously back and forth along the two belt sections unless retrieved by a player.

14. The apparatus as claimed in claim 1, wherein the moveable playing surface is mirrored.

15. The apparatus as claimed in claim 1, wherein the pusher device comprises an arcuate blade.

16. An amusement apparatus, comprising:

a moveable belt surface for transporting prize items distributed on the surface in a first path, the surface comprising at least one conveyor belt;

at least one pusher device for moving across the moveable surface in a linear path between opposite end positions transverse to the first path and for pushing items in its path off the moveable surface;

a reversible drive mechanism for moving the pusher device back and forth along its linear path;

delivery means adjacent one end position for delivering items pushed from the moveable surface by the pusher device to an operator; and control means for controlling operation of the reversible drive mechanism, including a player control assembly for allowing at least partial control by the player of the movement of the pusher device towards the delivery means.

* * * * *